United States Patent [19]

LaTorre et al.

[11] 4,210,804

[45] Jul. 1, 1980

[54] FREE-GYRO OPTICAL SEEKER

[75] Inventors: Richard R. LaTorre, Bedford; Barry N. Levitt, Framingham; Gordon C. MacKenzie, North Billerica, all of Mass.

[73] Assignee: Raytheon Company, Lexington, Mass.

[21] Appl. No.: 936,269

[22] Filed: Aug. 22, 1978

[51] Int. Cl.[2] ..... F42B 15/02

[52] U.S. Cl. ..... 250/203 R; 244/3.16; 250/236

[58] Field of Search ..... 244/3.16; 250/203 R, 250/236, 342; 350/6.6; 356/141, 152

[56] References Cited

U.S. PATENT DOCUMENTS

| | | | |
|---|---|---|---|
| 3,920,200 | 11/1975 | Evans et al. | 244/3.16 |
| 4,010,365 | 3/1977 | Meyers et al. | 250/236 |
| 4,039,246 | 8/1977 | Voigt | 250/203 R X |

*Primary Examiner*—David C. Nelms
*Assistant Examiner*—Edward P. Westin
*Attorney, Agent, or Firm*—Philip J. McFarland; Joseph D. Pannone

[57] ABSTRACT

A "free-gyro" configuration of an optical seeker is shown to consist of a focusing and reticle arrangement rotatable about a point on an axis and an optical detector array translatable along a path parallel to such axis to maintain the center of such detector array on the image plane of the focusing and reticle means.

2 Claims, 2 Drawing Figures

FREE-GYRO OPTICAL SEEKER

The invention herein described was made in the course of or under a contract or subcontract there under with the Department of Defense.

BACKGROUND OF THE INVENTION

This invention pertains generally to guidance systems for missiles and particularly to systems of such type wherein optical sensors are used to detect targets.

It is well known in the art that optical sensors may be incorporated in guidance systems for many different types of missiles. Such sensors ordinarily include focusing means, reticle means and detector means which are so related to one another that radiant energy from a target ultimately may cause electrical signals indicative of the line of sight between the target and the missile to be generated. Such electrical signals then may be processed along with positional signals to derive the requisite guidance commands to effect an intercept.

In some types of optical sensors the focusing means, the reticle means and the detector means are mounted on a gyroscopically stabilized platform within a two-axis gimbal set. Unfortunately, however, it is extremely difficult and expensive to make satisfactory optical sensors, especially when the detector means requires cryogenic cooling.

In order to reduce the complexity of an optical sensor a so-called "free gryo" configuration is sometimes used. In such a configuration the detector means is fixed to the body of the missile with the focusing means and at least a part of the reticle means mounted in a fixed relationship to one another on a universal joint. The focusing means and the part of the reticle means so mounted may be rotated and turned together through a range of gimbal angles. It will be appreciated that, if a detecting element is located at the center of the universal joint and if the received optical energy need not be focused precisely on such an element, the "free-gyro" configuration may be made much more easily with a fewer number of components. Further, it will be recognized that the "free-gyro" configuration may operate satisfactorily through an appreciable range of gimbal angles.

A different situation obtains when (as in cases wherein arrays of detecting elements are required) a detecting element cannot be mounted at the center of the universal joint or precise focusing is required. In such cases the range of gimbal angles through which satisfactory operation is possible is severly restricted.

SUMMARY OF THE INVENTION

In view of the foregoing background of this invention it is a primary object of this invention to provide an improved "free-gyro" configuration for an optical sensor wherein an array of detecting elements may be used.

Another object of this invention is to provide an improved "free-gyro" configuration for an optical sensor wherein defocusing effects are minimized through a range of gimbal angles.

The foregoing and other objects of this invention are attained generally by providing, in a "free-gyro" configuration of an optical sensor in a missile guidance system, an array of detecting elements mounted at a distance from the center of the focal plane of the focusing means in such sensor and means for translating the array of detecting elements so that the center of such array remains on the focal plane of the focusing means as the gimbal angle is changed through a predetermined range.

BRIEF DESCRIPTION OF THE DRAWINGS

For a more complete understanding of this invention, reference is now made to the following description of a preferred embodiment illustrated in the accompanying drawings wherein.

DESCRIPTION OF THE PREFERRED EMBODIMENTS

Figure 1:
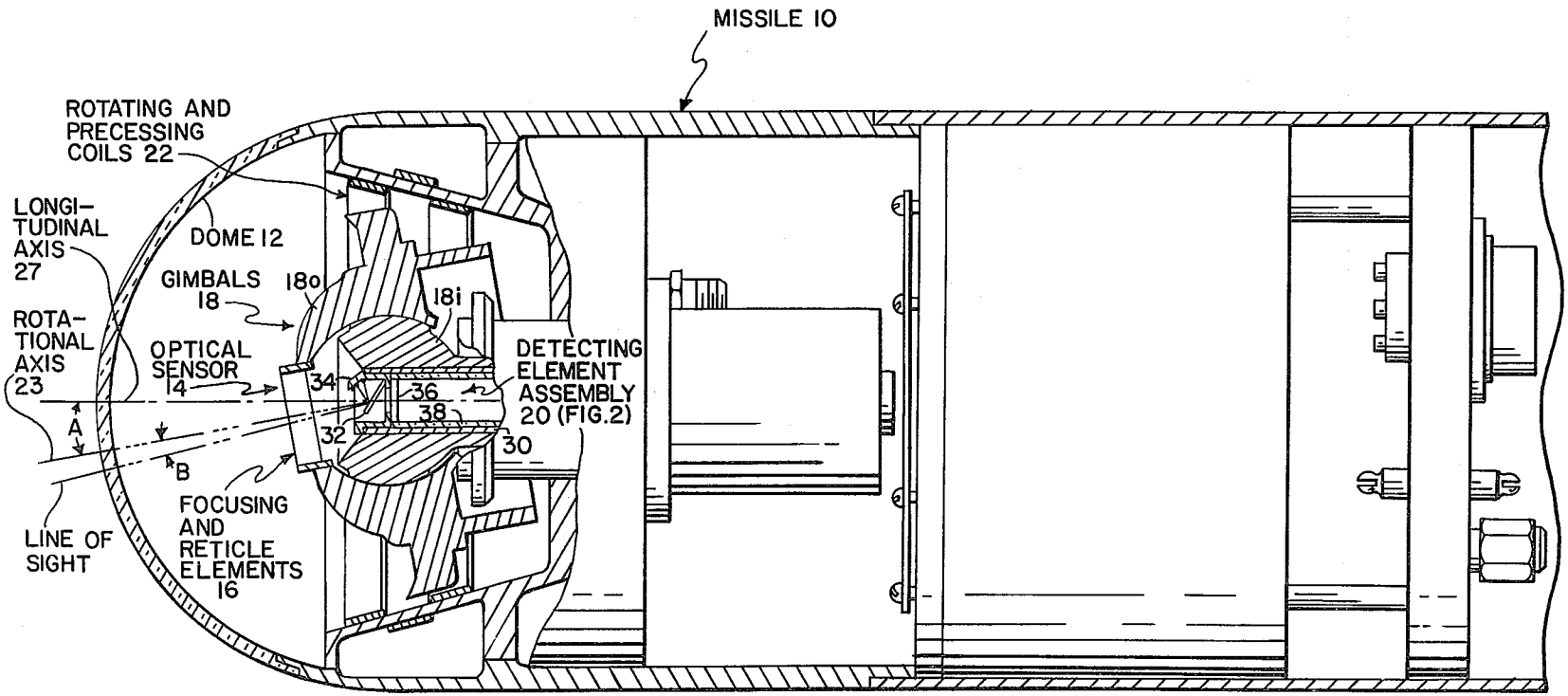
FIG. 1 is a sketch, greatly simplified, of an optical sensor according to this invention.

Before referring to the drawings in detail, it will be observed that conventional portions of an optical seeker required for an understanding of this invention have, whenever possible, been indicated in the simplest manner for expository reasons. Thus, as shown in FIG. 1, the forward end of a missile 10 is shaped to accommodate a dome 12 which is substantially transparent to optical energy from a target (not shown). An optical sensor 14 (here generally consisting of focusing and reticle elements 16, gimbals 18 and a detecting element assembly 20) is disposed within the missile 10 behind the dome 12. The gimbals 18 include an outer gimbal (indicated by the numeral **18*o*) and an inner gimbal (indicated by the numeral 18*i*) with complementary spherical surfaces to form a kind of universal joint. Preferably, pressurized gas is forced between the complementary spherical surfaces in a conventional manner (not shown). The inner gimbal 18*i* (as shown more clearly in FIG. 2) is affixed to the body (not numbered) of the missile 10. Rotating and precessing coils 22, again of conventional construction, are positioned as shown about the outside of the outer gimbal 18*o*. With the peripheral portions of the latter shaped to form magnetic poles, it will be appreciated that the outer gimbal 18*o* may constitute the rotor of an electric motor and that appropriate energization of the rotating and precessing coils 22 may cause the outer gimbal 18*o* (and the focusing and reticle elements 16) to be rotated about a rotational axis 23 which may be oriented within limits at an angle "A" with respect to the longitudinal axis 27 of the missile 10**. The angle "A" then is the angle commonly referred to as the "gimbal angle".

It will now be appreciated that the just described arrangement constitutes a "free gyro" configuration. That is to say, the rotational axis 23 is stabilized in inertial space.

A cylindrical journal (not numbered) is centrally formed as shown in the inner gimbal **18*i* to accommodate the detecting element assembly 20. Suffice it to say here that that assembly includes a hollow detector mount 30 having a portion of its outside formed substantially to complement the cylindrical journal (not numbered) in the inner gimbal 18*i* so that the detector assembly 20 may be moved along the longitudinal axis of the missile 10. A dichroic mirror 32, an array of optical sensors 34, a window 36 and a detector housing 38 are disposed as shown within the hollow detector mount 30. The detector housing 38 here includes a conventional Dewar flask and an array of infrared detectors (not shown), but located at a distance from the center of the inner gimbal 18*i*. Suffice it to say that infrared energy from any source within the field of view of the focusing and reticle elements 16 may pass through the dichroic mirror 32 and the window 36 to be sensed by an appropriate detector (not shown in FIG. 1**).

The array of optical sensors 34 (here three in number and responsive to optical energy reflected by the dichroic mirror 32) are disposed radially so that, with a gimbal angle of zero degrees, the centrally located one of such detectors is energized by optical energy from a target (not shown) on the longitudinal axis (extended) of the missile 10. It follows, then, that if the line of sight to the target is slightly above or below the longitudinal axis (extended) of the missile 10, the focused optical energy energizes one or the other of the optical sensors. On the other hand, if the line of sight to the target is slightly to the left or right of the longitudinal axis (extended) of the missile 10, the focused optical energy remains on the centrally located one of the optical sensors in the array of optical sensors 34. A similar situation basically obtains (except that the rotational axis 23 replaces the longitudinal axis (extended) of the missile 10) when the gimbal angle differs from zero. That is to say, the position of the focused optical energy on the array of optical sensors 34 changes with pitch of the rotational axis 23 and is substantially invariant with yaw.

It will now be observed that, as the pitch axis of the rotational angle 23 is changed, the focal plane of the focusing and reticle elements 16 rotates so that substantial coincidence between that plane and the plane of the array of optical sensors 34 is lost. To put it another way, optical energy is defocused on the array of optical sensors 34 unless some measures are taken to compensate for pitch. According to this invention the measure so taken is to move the array of optical sensors 34 along the longitudinal axis 27 of the missile 10 until the focal plane of the focusing and reticle elements corresponds substantially with the centrally located one of the array of optical elements 34.

Figure 2:
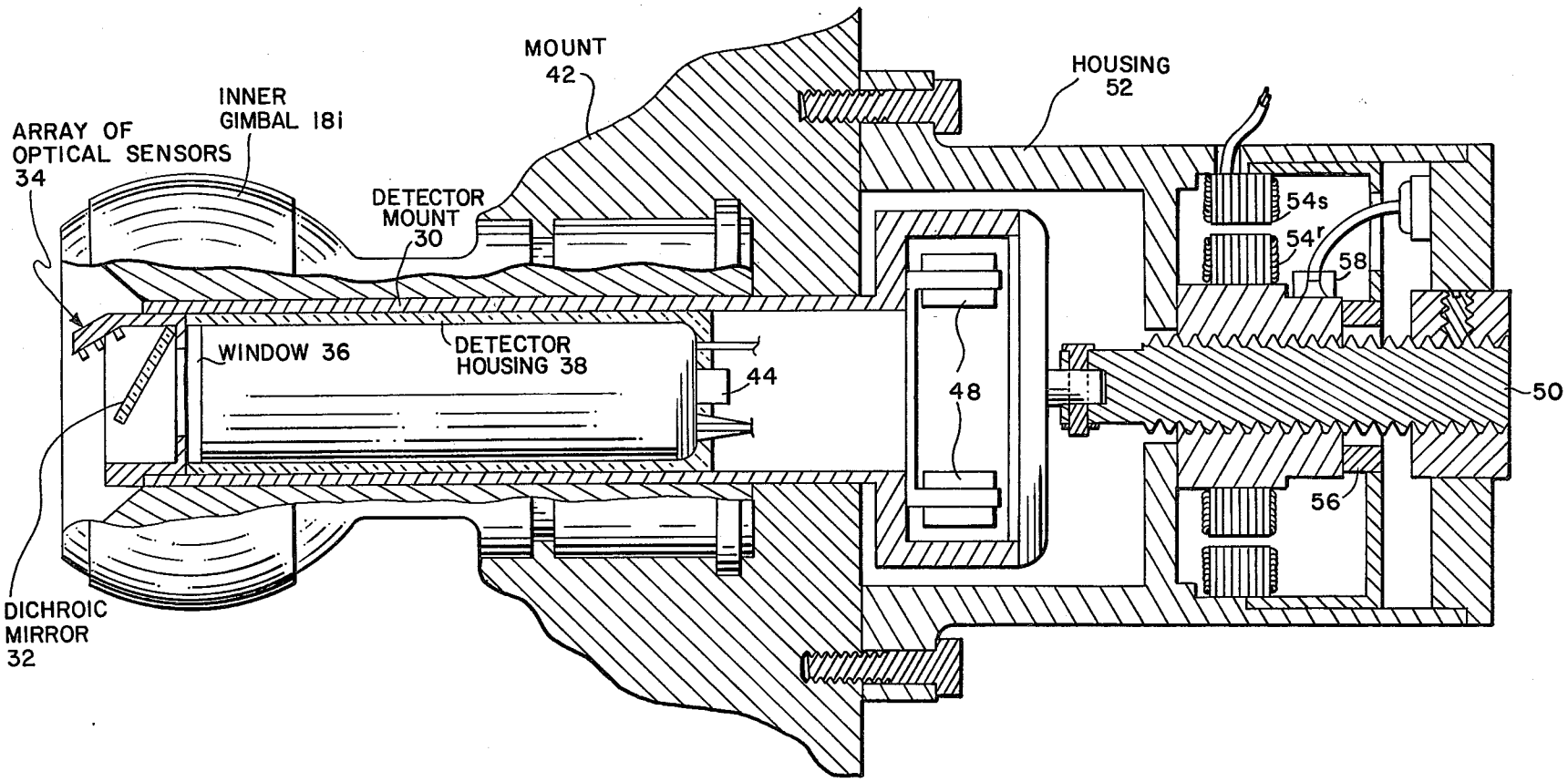
FIG. 2 is a cross-sectional view of the central portion of the optical sensor shown in FIG. 1.

Referring now to FIG. 2, details are illustrated of the central portion of the optical sensor of FIG. 1 which are necessary to an understanding of how translation of the array of optical sensors 34 is effected. Thus, as mentioned herebefore, the hollow detector mount 30 is slidably supported within the inner gimbal 18*i*. The after end of that gimbal is secured in a mount 42 which, in turn, is secured to the body of the missile 10 (FIG. 1). A container 44 for a cryogenic gas, an infrared detector (not shown) and preamplifiers 48 are also mounted within the hollow detector mount 30. Additionally, appropriate electrical connections (not shown) are made between the various optical sensors and the preamplifiers 48 and from such preamplifiers to the remaining parts of the guidance system.

The after end of the hollow cylindrical detector mount 30 is formed to mate with a clevis (not numbered) on the forward end of a threaded member 50. The after end of the threaded member 50 is shaped to slide in a noncircular opening formed through a wall (not numbered) in a housing 52. The threaded portion of the threaded member 50 mates with a rotor 54*r* of an electric motor (not numbered). A thrust bearing 56 serves to maintain the longitudinal position of the rotor 54*r*, i.e. prevents movement other than rotational movement of the rotor 54*r*. The stator 54*s* is affixed to the housing 52. A potentiometer 58 is mounted as indicated ultimately to provide an indication of the position of the threaded member 50. Thus, with the electric motor (not numbered) energized, the rotor 54*r* is caused to rotate to generate a force on the threaded portion of the threaded member. Such force may be considered to be a vector made up of two vectors, one tangential to the threaded member 50 and the other aligned with the longitudinal axis of such member. Because the threaded member 50 cannot rotate, the tangential vector is without effect, but (also because the rotor 54*r* can rotate) the longitudinal vector causes the threaded member 50 to be translated along its longitudinal axis.

Having described a preferred embodiment of this invention, it will now be apparent to one of skill in the art that the concept of adjusting the position of an optical detector (effectively offset from the image plane of the focusing means in a "free gyro" configuration of a seeker) to compensate for rotation of the image plane of focusing means could be effected by rotation of the dichroic mirror. Additionally, the number, shape and disposition of the optical detectors within the array may be changed. It is felt, therefore, that the invention should not be restricted to its disclosed embodiment but rather should be limited only by the spirit and scope of the appended claims.

What is claimed is:

1. In an optical seeker for a guided missile having a longitudinal axis, such seeker including focusing means spin-stabilized about a movable line of sight having a point in common with the longitudinal axis, optical sensor means disposed in the focal plane of the focusing means when the line of sight and the longitudinal axis are coincident and a mirror disposed between the focusing means and the optical sensor means to position the center of the focal plane at a point removed from the longitudinal axis, the improvement comprising:

(a) a universal joint having a first part affixed to the guided missile and a second part rotatably mounted on the first part, the opposing surfaces of the first and second part being complementary spherical surfaces centered on the longitudinal axis of the guided missile;

(b) a passageway formed through the first part coaxially with the longitudinal axis of the guided missile;

(c) a hollow support member slidably disposed within the passageway to position the optical sensor means and the mirror along the longitudinal axis of the guided missile;

(d) means for affixing the focusing means to the second part of the universal joint and for orienting and spinning such second part and focusing means to spin-stabilize the optical axis of the focusing means in a given direction; and (e) means for moving the hollow support member along the longitudinal axis in accordance with the direction of the line of sight of the focusing means to maintain the center of the focal plane of such focusing means substantially in coincidence with the center of the optical sensor means.

2. The optical seeker as in claim 1 wherein the means for moving comprises:

(a) an electric motor having a stator and a rotor;

(b) a thrust bearing for maintaining the longitudinal position of the rotor relative to the stator;

(c) a lead screw driven by the rotor;

(d) means for inhibiting rotation of the lead screw; and (e) means for connecting the lead screw to the hollow support member.

* * * * *